US009074471B2

(12) United States Patent
Ojanen

(10) Patent No.: US 9,074,471 B2
(45) Date of Patent: Jul. 7, 2015

(54) INSERT WITH OFFSET APEX FOR A CUTTER BIT AND A CUTTER BIT HAVING THE SAME

(71) Applicant: Randall Walter Ojanen, Bristol, TN (US)

(72) Inventor: Randall Walter Ojanen, Bristol, TN (US)

(73) Assignee: KENNAMETAL INC., Latrobe, PA (US)

( * ) Notice: Subject to any disclaimer, the term of this patent is extended or adjusted under 35 U.S.C. 154(b) by 107 days.

(21) Appl. No.: 13/959,258

(22) Filed: Aug. 5, 2013

(65) Prior Publication Data

US 2015/0035343 A1 Feb. 5, 2015

(51) Int. Cl.

| | |
|---|---|
| ***E21C 35/183*** | (2006.01) |
| ***B28D 1/18*** | (2006.01) |
| *E21C 35/18* | (2006.01) |

(52) U.S. Cl.

CPC ..... *E21C 35/183* (2013.01); *B28D 1/186* (2013.01); *E21C 2035/1816* (2013.01)

(58) Field of Classification Search

USPC ..... 299/79.1, 100, 101, 108, 111, 113; 175/420.1, 420.2, 426, 428, 430–432, 175/434, 435

See application file for complete search history.

(56) References Cited

U.S. PATENT DOCUMENTS

| | | | | |
|---|---|---|---|---|
| 4,858,707 | A | 8/1989 | Jones et al. | |
| 5,415,244 | A * | 5/1995 | Portwood | 175/374 |
| 5,435,403 | A * | 7/1995 | Tibbitts | 175/432 |
| 5,697,462 | A * | 12/1997 | Grimes et al. | 175/374 |
| 7,588,102 | B2 | 9/2009 | Hall et al. | |
| 7,665,552 | B2 | 2/2010 | Hall et al. | |
| 8,028,774 | B2 | 10/2011 | Hall et al. | |
| 2001/0004946 | A1 | 6/2001 | Jensen | |
| 2004/0094334 | A1 * | 5/2004 | Singh | 175/430 |
| 2008/0190666 | A1 * | 8/2008 | Gatell | 175/57 |
| 2012/0031674 | A1 * | 2/2012 | Lyons | 175/57 |
| 2012/0242136 | A1 | 9/2012 | Ojanen | |

FOREIGN PATENT DOCUMENTS

| | | | |
|---|---|---|---|
| WO | 2013014192 | A2 | 1/2013 |
| WO | 2013064433 | A2 | 5/2013 |

* cited by examiner

*Primary Examiner* — Sunil Singh
(74) *Attorney, Agent, or Firm* — Matthew W. Gordon

(57) ABSTRACT

A non-rotatable cutter bit for mining and construction operations having a central longitudinal axis extending therethrough includes an insert at one end. The insert has a central longitudinal axis and the apex is offset from the central longitudinal axis to provide an elongated rake face. With the insert mounted within the cutter body, the central longitudinal axis of the cutter body intersects with the apex such that the cutter body may be easily exchanged with conventional cutter bodies. The insert may also be mounted directly to the body without using an insert holder. The insert also has applications in oil and gas drilling operations.

31 Claims, 9 Drawing Sheets

INSERT WITH OFFSET APEX FOR A CUTTER BIT AND A CUTTER BIT HAVING THE SAME

BACKGROUND OF THE INVENTION

1. Field of the Invention

This invention is related to a cutter bit that is used for the impingement of substrate for earth strata such as, for example, asphalted roadway surface, coal deposits, and mineral formations. More specifically, the invention relates to a cutter bit having a hard tip insert protruding therefrom, wherein the insert has an offset apex.

2. Description of Related Art

A cutter bit for use in mining or construction applications typically has a generally elongated cylindrical geometry. Such a cutter bit comprises an elongated steel cutter bit body which has an axially forward end and an opposite axially rearward end. A cutter insert of hard or super hard material typically affixes to the axial forward end of the cutter bit body. The cutter bit body typically is rotatably or non-rotatably secured to a stationary block or holder on a drum.

Cutter bits experience wear in a number of ways due to the environment in which they operate and must be frequently replaced. It is highly desirable to provide an improved cutter bit that experiences an increase in useful tool life as compared to heretofore known cutter bits.

FIG. 1 illustrates a portion of a continuous mining machine 10 comprised of a rotatable shaft 12 having a first sprocket 14 and an associated drive chain 15 which is driven by a second sprocket 17. Attached to the drive chain 15 are a plurality of cutter links 20 each containing a cutter bit 25. Each cutter bit 25 has an insert 27 which contacts earth strata S or road pavement to break up material for removal. During the operation, as the insert 27 moves through the substrate S a force FR is applied to the insert 27. Typically, the force FR acts upon the cutter insert 27 along a line that forms an angle X with the central longitudinal axis 32 of the cutter body 30 of between 5-20°. FIG. 2 is a portion of FIG. 1 enlarged to show details of the cutter bit 25. As illustrated in FIGS. 2 and 3, when the force FR is applied to the insert 27 there is a region U behind the insert 27 that is unsupported. Directing attention to FIG. 3, typically, the cutter bit 25 is comprised of the body 30 having a central longitudinal axis 32 extending therethrough. An insert holder 35 is secured to the body 30 and the insert 27 is secured within the insert holder 35. Typically, the insert 27 has a cemented carbide body with a conical tip 28. The insert holder 35 is carbide such that the insert 27 may be brazed into the holder 35. Such a cutter bit is disclosed in United States Patent Application Publication No. US 2012/0242136, which is hereby incorporated herein in its entirety.

Returning to FIG. 3, typically the resultant force FR is broken into an axial component FA parallel to the central longitudinal axis 32 and a lateral component FL perpendicular to the central longitudinal axis 32. Because the region U is unsupported, the lateral force FL applies an undesirable bending moment to the cutter insert 27. While the inserts are typically made of cemented carbide, they may also be made of other super hard materials. Each of these materials has a very high compressive strength but a relatively low tensile strength. As a result, a design is sought to provide additional support to the insert against the lateral force acting upon it to minimize bending moments caused by the lateral force. Additionally, in other prior art designs, the conical tip of the cutter insert 27 was not made of cemented carbide, but was made entirely of PCD (polycrystalline diamond) to compensate for the unsupported region U of the insert 27. A design is sought that would eliminate or reduce the amount of PCD used in these inserts 27.

SUMMARY OF THE INVENTION

An insert used for earthworking and/or road milling applications is comprised of a body with a first end and a second end. The body comprises a base extending from the first end and a central longitudinal axis through the base. The base is defined by an ellipsoid about the longitudinal axis. There is an apex at the second end, wherein the apex is offset from the longitudinal axis. There is a transition region between the base and the apex, wherein the transition region is symmetric about a plane extending through the apex and through the longitudinal axis.

Another embodiment is directed to a non-rotatable cutter bit comprising a body having a central longitudinal axis extending therethrough, an insert holder secured within the body, and an insert secured within the insert holder. The insert has a body with a first end and a second end. The body comprises 1) a base extending from the first end and a longitudinal centerline through the base, wherein the base is defined by an ellipsoid; 2) an apex at the second end, wherein the apex is offset from the centerline defining a rake face side and a relief face side; and 3) a transition region between the base and the apex. The transition region is symmetric about a plane extending through the apex and through the centerline and the central longitudinal axis extends through the apex.

DESCRIPTION OF THE INVENTION

Figure 1:
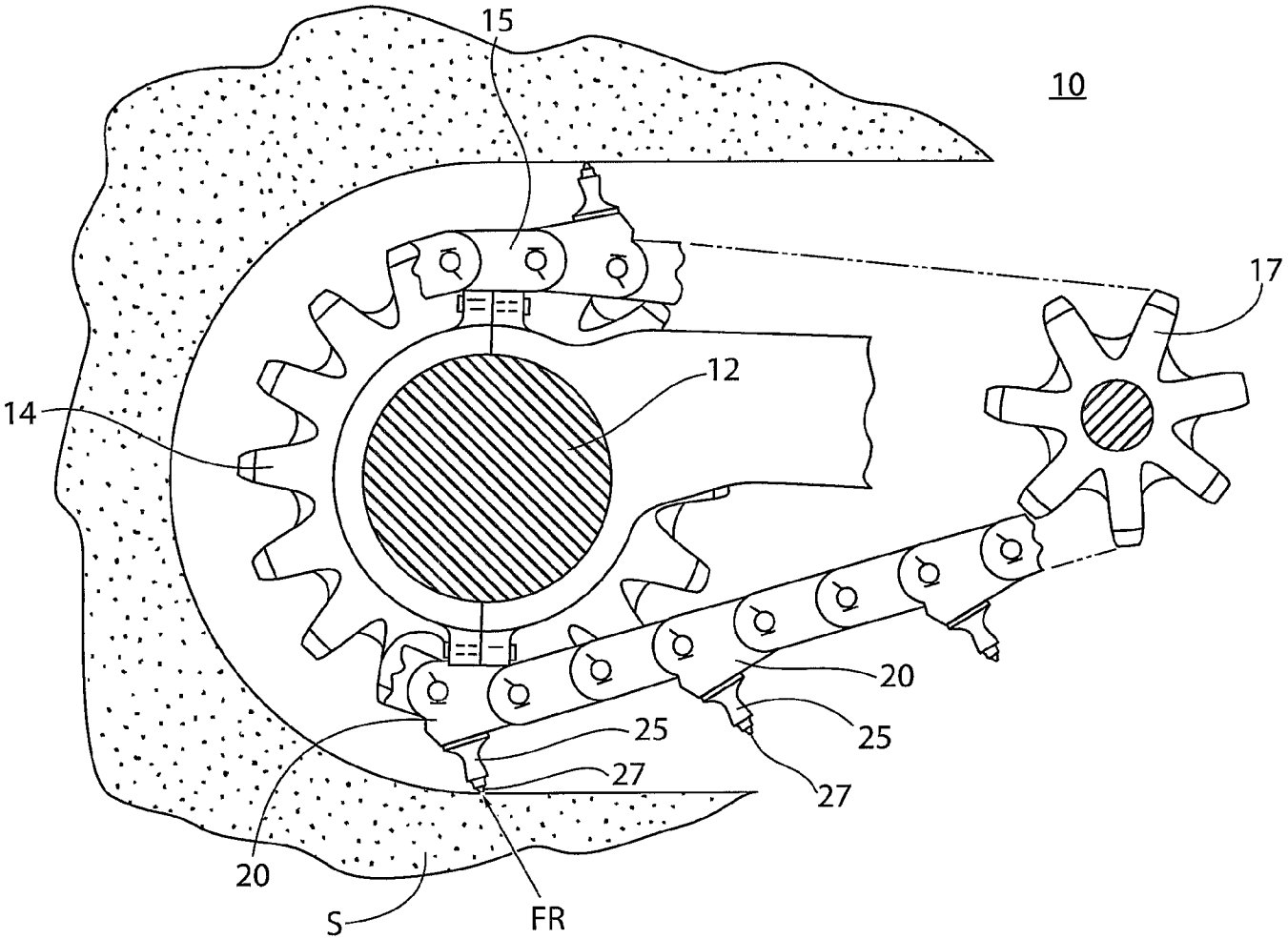
PRIOR ART FIG. 1
FIG. 1 is prior art and illustrates a side view of a portion of a continuous mining machine in operation.
Figure 2:
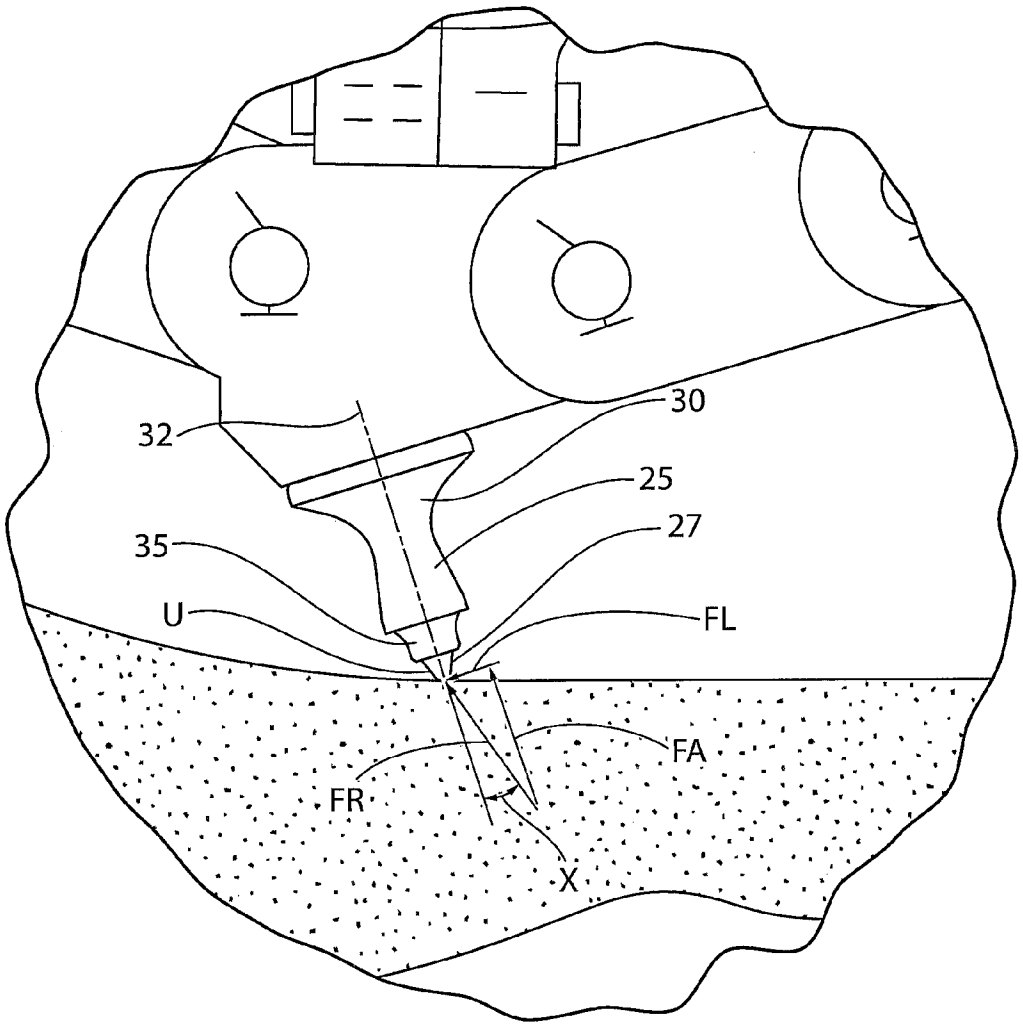
PRIOR ART FIG. 2
FIG. 2 is an enlarged portion of part of FIG. 1.
Figure 4:
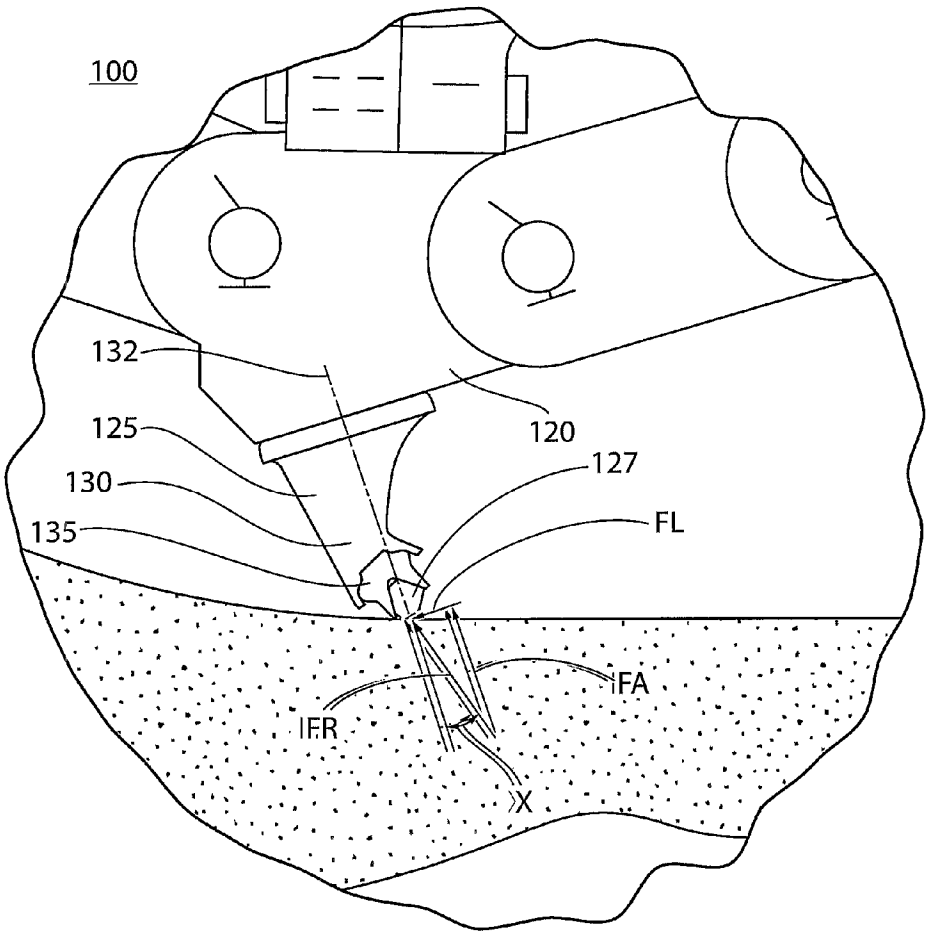
FIG. 4 is a view similar to that of FIG. 2, however, utilizing the cutter bit in accordance with the subject invention.

FIG. 4 is a view similar to that of FIG. 2, however, substitutes the conventional cutter bit 25 with a cutter bit 125 in accordance with the subject invention. In particular, FIG. 4 illustrates a drum assembly 100 for earthworking and/or road milling operations including all of the elements discussed with respect to FIG. 2 with the exception that the cutter bit 25 illustrated in FIG. 2 is replaced with the cutter bit 125 discussed herein. The rotary shaft (not shown) includes at least one cutter link 120 extending radially therefrom with an aperture (not shown) to accept a cutter bit 125. Just as with respect to FIG. 2, the force FR acting upon the insert 127 forms an angle X with the central longitudinal axis 132 of the cutter body 130 of between 5-20°. However, as can be seen, the insert holder 135 provides greater support to the modified insert 127 against the lateral force FL.

Figure 5:
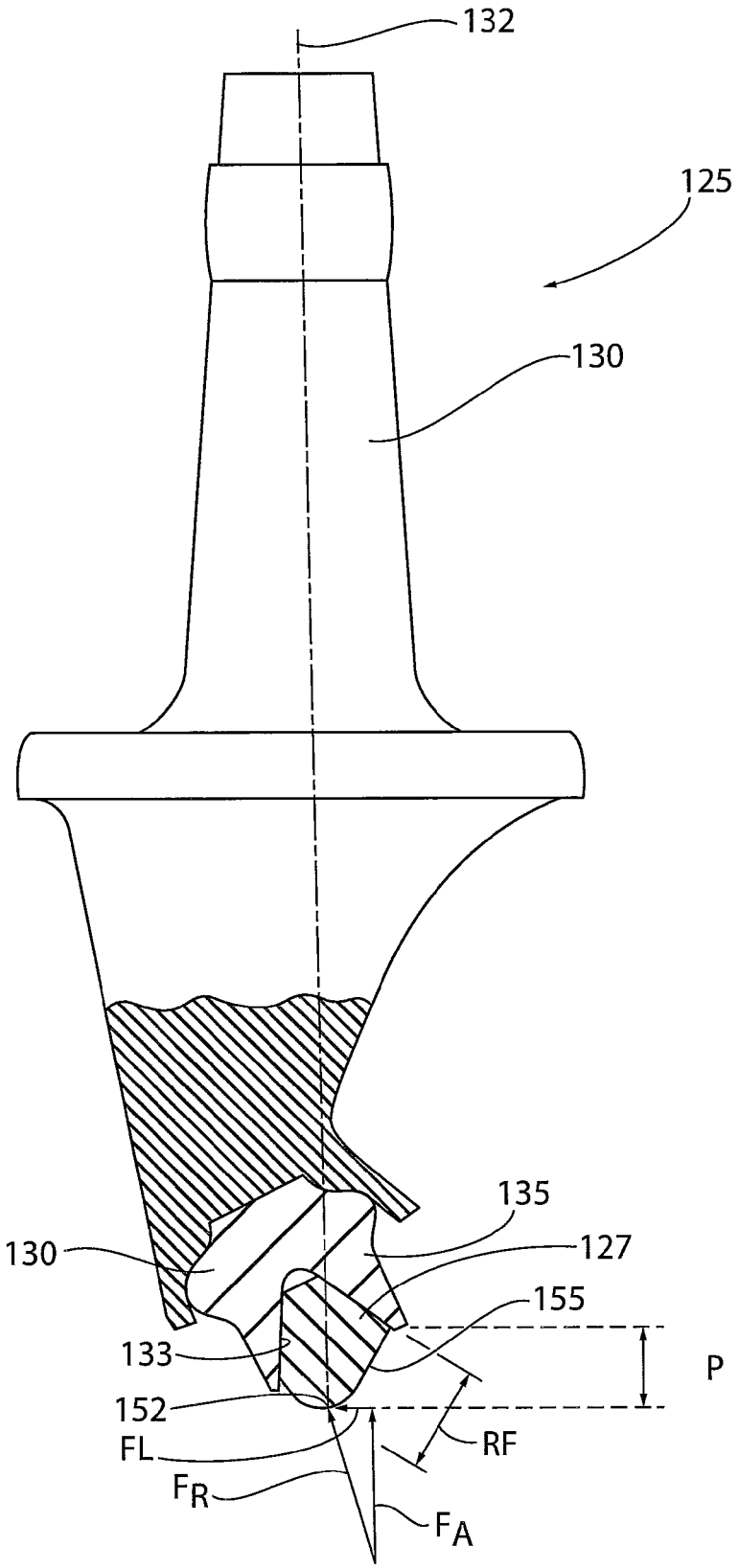
FIG. 5 is a side view with a partial sectional view of a cutter bit in accordance with the subject invention including an insert having an offset apex and an insert holder to accommodate the same.

FIG. 5 illustrates the cutter bit 125 with the body 130 with the central longitudinal axis 132 extending therethrough. The insert holder 135 is secured within the body 130 and the insert 127 is secured within the insert holder 135. Once again, the force FR has been broken into an axial component FA along the central longitudinal axis 132 and a lateral component FL perpendicular to the central longitudinal axis 132. It is the lateral force FL that imposes the greatest bending moment upon the insert 127.

Figure 8:
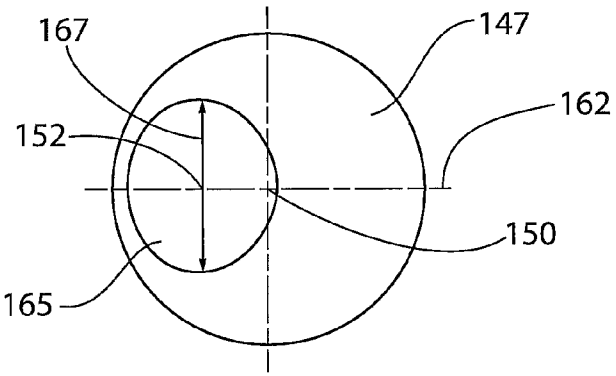
FIG. 8 is a bottom view of the insert, in accordance with the subject invention.

Directing attention to FIGS. 6-9, the insert has a body 140 with a first end 142 and a second end 145. The body 140 comprises a base 147 extending from the first end 142 with a central longitudinal axis 150 extending therethrough. The base 147, when viewed looking along the longitudinal centerline 150, is defined by an ellipsoid, as illustrated in FIG. 8.

An apex 152 (FIG. 6) is at the second end 145 of the body 140 and is offset from the longitudinal centerline 150 by an amount Z defining a rake face side 155 and a relief face side 157. For an insert 127 having a diameter of 0.6 inches, the apex 152 may be offset an amount Z of between 0.09 and 0.16 inches and may be 0.10 inches.

A transition region 160 extends between the base 147 and the apex 152. The transition region 160 is symmetric about a plane 162 (FIG. 8) extending through the apex 152 and through the central longitudinal axis 150. The apex 152 and transition region 160 together define the insert tip 153.

Figure 3:
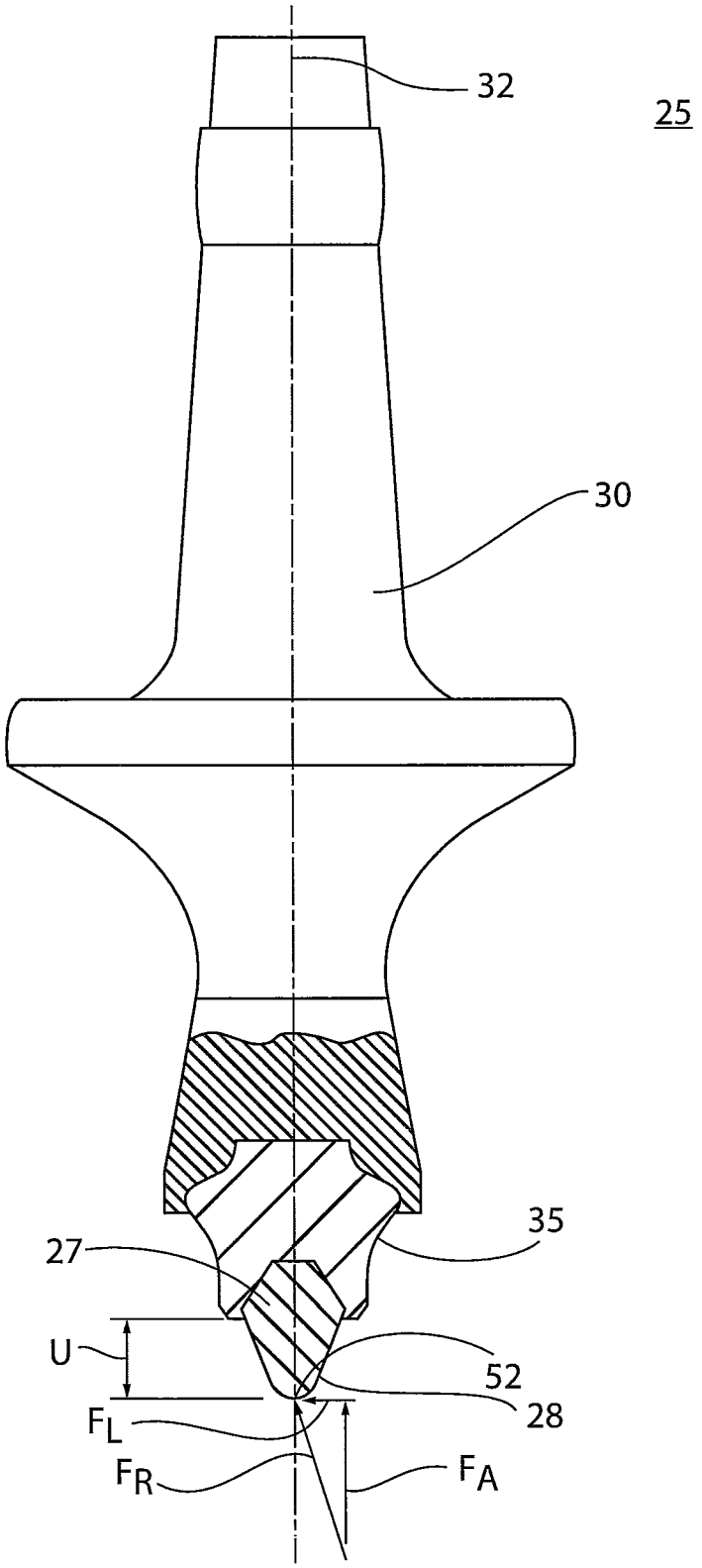
PRIOR ART FIG. 3
FIG. 3 is a side view with a partial sectional view of a prior art cutter bit having a symmetrical insert.

It should be noted, with respect to FIG. 5, that when the insert 127 is mounted within the cutter bit 125, the central longitudinal axis 132 of the cutter bit 125 extends through the apex 152 of the insert 127. The same is true with cutter bit 25 in FIG. 3, wherein the central longitudinal axis 32 intersects with the apex 52 of the insert 27.

This is relevant because, as a result of this design, it is possible to interchange the cutter bit 125 in accordance with the subject invention with conventional cutter bits, such as cutter bit 25, without changes to the lugs or other equipment used to secure the cutting bit within a machine. Therefore, it is just as easy to replace a conventional cutter bit with the cutter bit 125 in accordance with the subject invention as it is to replace it with another conventional cutter bit.

Figure 10:
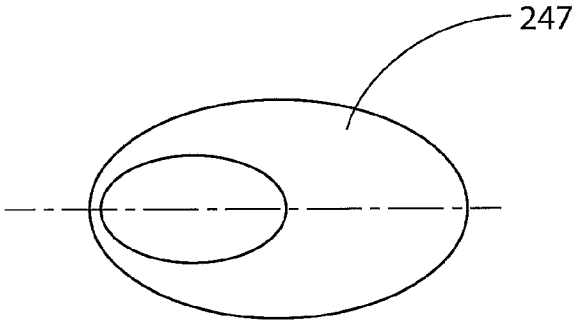
FIG. 10 is a second embodiment of the cutting bit viewed from the bottom in a manner similar to that of FIG. 8.

Directing attention again to FIGS. 6-9, the region surrounding the apex 152 has a radius R which may be between 0.05 inches and 0.25 inches for an insert 27 having a diameter of between 0.20 and 0.90 inches and may be 0.57 inches. Additionally, as illustrated in FIG. 8, when viewed along the longitudinal axis 150 toward the first end, the apex region 165 may be generally elliptical. Furthermore, the major axis 167 of the ellipse is perpendicular to the plane 162. However, it should be appreciated that the apex region 165 may be modified such that the major axis 167 of the ellipse is parallel on the same line as plane 162 (as shown in FIG. 10), not perpendicular, to the plane 162.

Figure 6:
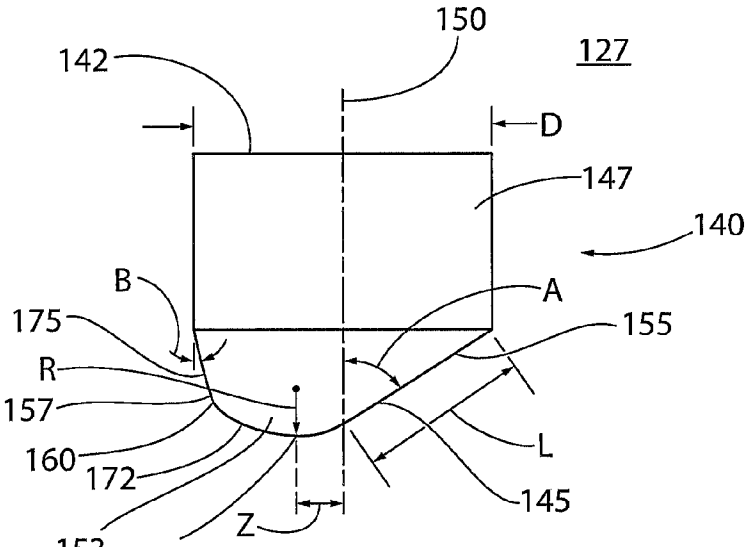
FIG. 6 is a side view of the insert, in accordance with the subject invention.
Figure 7:
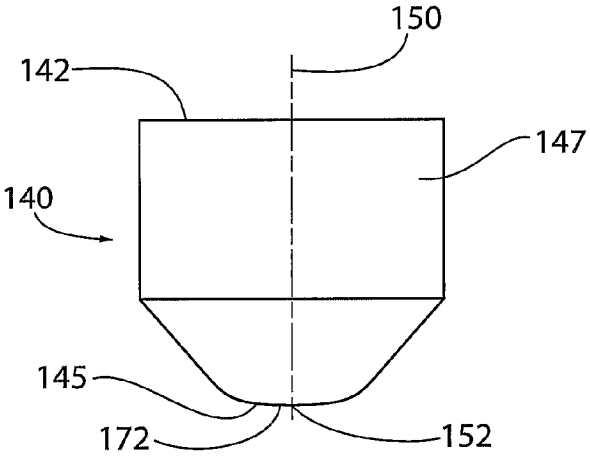
FIG. 7 is an end view of the insert, in accordance with the subject invention.
Figure 9:
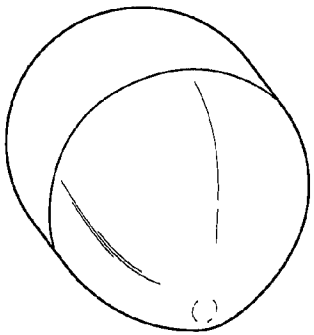
FIG. 9 is a perspective view of the insert, in accordance with the subject invention.
Figure 11:
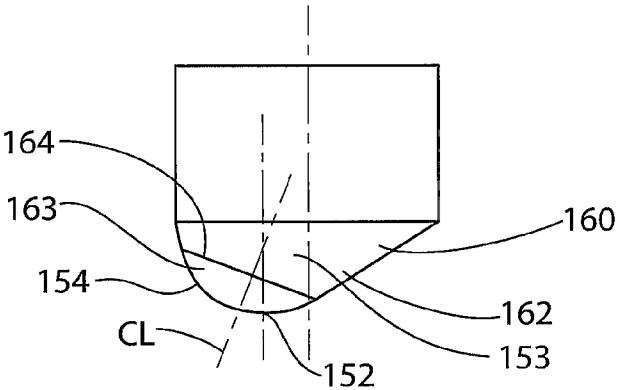
FIG. 11 is a side view of the cutting insert similar to that of FIG. 5.
Figure 12:
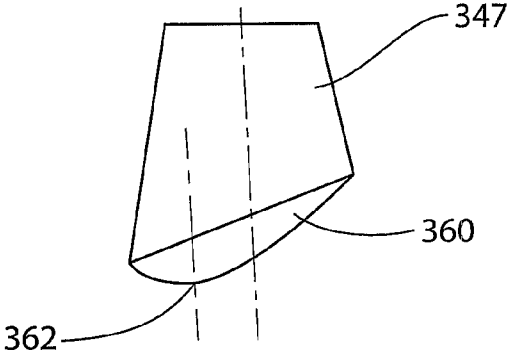
FIG. 12 is a side view of a variation of the cutting insert illustrated in FIG. 5.
Figure 13:
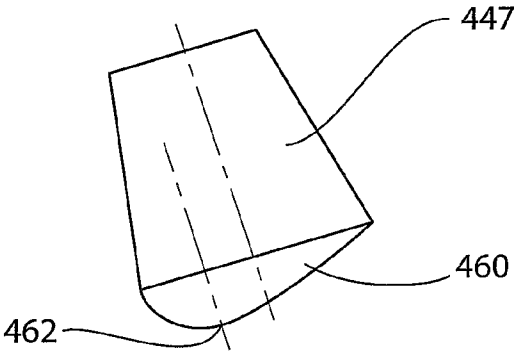
FIG. 13 is another variation of a side view of the cutting insert illustrated in FIG. 5.

FIG. 7 is a side view of the insert 127 illustrating that a portion 172 surrounding the apex 152 may have a flat with radiussed portions blending to the transition region 160. While the base 147 has been described as an ellipsoid, such an ellipsoid, as illustrated in FIGS. 6 and 8, is a cylinder. As illustrated in FIG. 10, the base 247 may be elliptical while, as illustrated in FIGS. 12 and 13, the base 347, 447 may have a frusto-conical shape. FIGS. 12 and 13 also indicate that the base 347, 447 may be rotated and the transition regions 360, 460 and apexes 362, 462 could remain at the same orientation. As seen for the insert 127 in FIG. 11, which is identical to insert 127 shown in FIGS. 6-9, the transition region 160 may, in part, be a frusto-conical section 162 having a cone centerline CL.

Additionally, the transition region 160 may include a radiussed dome 163 delimited by a line 164. A PCD or CBN (cubic boron nitride) coating, in one embodiment, would be applied onto the cemented carbide body 142 but only to the tip 153, which is bordered by the heavier line 154 in FIG. 11. The thickness of the coating may be between 0.02 and 0.06 inches and the techniques for applying such coatings are well known in the art.

Returning to FIG. 6, the rake face side 155 of the transition region 160 is generally straight extending a length L of at least one-half of the diameter D of the insert body 140 and forms an acute angle A with respect to the central longitudinal axis 150 of between approximately 35-75°, and may be 55°.

In one particular example, the base diameter D is 0.5 inches and the rake side has a straight portion for a length of approximately 0.30 inches. Additionally, as illustrated in FIG. 6, the transition region 160 opposite the rake face side 155 defines a relief face side 157 that is generally curvilinear but may include a straight segment 175 transitioning to the base 147. The straight segment 175 may form an angle B of between 8-14° with the central longitudinal axis 150.

In the past, with conventional designs, it would be necessary to fabricate the tip 28 of insert 27 (FIG. 3) entirely of PCD or CBN. However, in light of the modified geometry of the insert 127, the resultant redistribution of forces through the insert body 140, and reduced bending moments upon the insert body 127, it is now possible to use a cemented carbide body 140 and only coat the tip 153. This eliminates the need to fabricate the entire insert tip of PCD or CBN, resulting in a substantial material reduction and reduced cost.

Returning to FIG. 5, the insert 127 is illustrated mounted within an insert holder 135. In accordance with the subject invention, it should be appreciated that the length of RF represents the length of the rake face side 155 of the insert 127. For at least 90% of the length of RF, a projection perpendicular to the rake face side 155 toward the longitudinal axis 132 intersects with a face 133 of the body 130 of the bit holder 135. In the alternative, for at least 90% of the length RF of the rake face side 155, a projection perpendicular to the longitudinal axis 132, identified by length P, through the rake face side 155 intersects with the face 133 of the body 130 of the bit holder 135.

What has so far been discussed is an insert 127 (FIG. 6) having a body 130 with a base 147 having an apex 152 and a transition region 160 defining an insert tip 153. While the base 147 has been made of cemented carbide, the tip 153, has in one embodiment also been made of cemented carbide and coated with CBN or PCD. In another embodiment, the base 147 has been made of cemented carbide and the entire tip 153 has been made of PCD or CBN.

Figure 14:
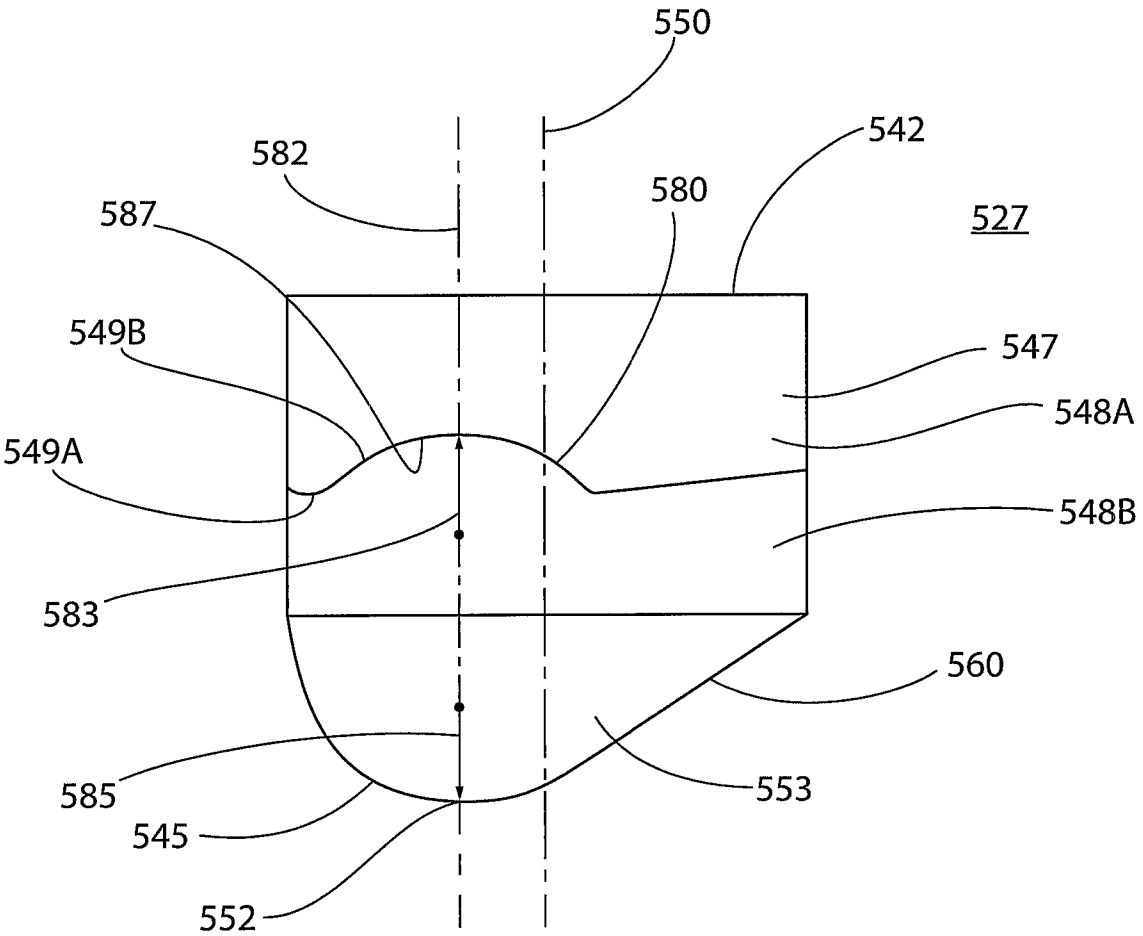
FIG. 14 is a view similar to that of FIG. 6 but with a break line introduced highlighting the separation between the carbide steel portion of the insert and the PCD or CDN portion of the insert.

In another embodiment, as illustrated in FIG. 14, the design is similar to that illustrated in FIG. 6. The reference numbers in FIG. 14 are now in the 500 series, but unless otherwise indicated, the overall shape of the insert remains unchanged and the similar 100 series numbers in FIG. 6 identify the same parts. The only difference is that in an earlier embodiment, the entire tip was PCD or CBN and now the PCD or CBN material extends beyond the tip and into a portion of the base.

In particular, insert 527 includes a first end 542 and a second end 545 with a base 547 and an offset apex 552 as previously described. A transition region 560 extends between the apex 552 and the base 547 and together the apex 552 in the transition region 560 define the tip 553. In this embodiment the entire tip 560 is made up of PCD or CBN but, furthermore, while a first portion 548A of the base 547 is cemented carbide, the remainder of the base 548B is made up of the same material as the tip 560. In particular, the second portion of the base 548B and the tip 560 together are made of PCD or CBN. The first portion 548A of the base 547 has a mating surface 549A which conforms to a mating surface 549B of the second portion 548B. The first portion 548A which is cemented carbide is bounded to the second portion 548B which is PCD or CBN using techniques known to those skilled in the art.

Of particular interest, the mating surface 549B of the second portion 548B includes a protrusion 580. The protrusion 580 may be centered about a line 582 that is offset from and parallel to the longitudinal axis 550 of the base 547. This line 582 may extend through the apex 552. Furthermore, the protrusion 580 may be defined by a radius 583. It should be noted in the embodiment illustrated in FIG. 14, the region about the apex 552 may also be defined by a radius 585. In one embodiment the radius 583 of the protrusion 580 may be identical to the radius 585 in the region of the apex 552. Additionally, the centers of the radii 584, 586 may lie along the common line 582. By providing the protrusion 580 in the second portion 584B of the base 547, lateral forces that may be applied to the tip 553 during operations will be resisted by the protrusion 580 mounted within a matching depression 587 of the first portion 548A, thereby reducing the stress on the bond between the first portion 548A and the second portion 548B.

Figure 15:
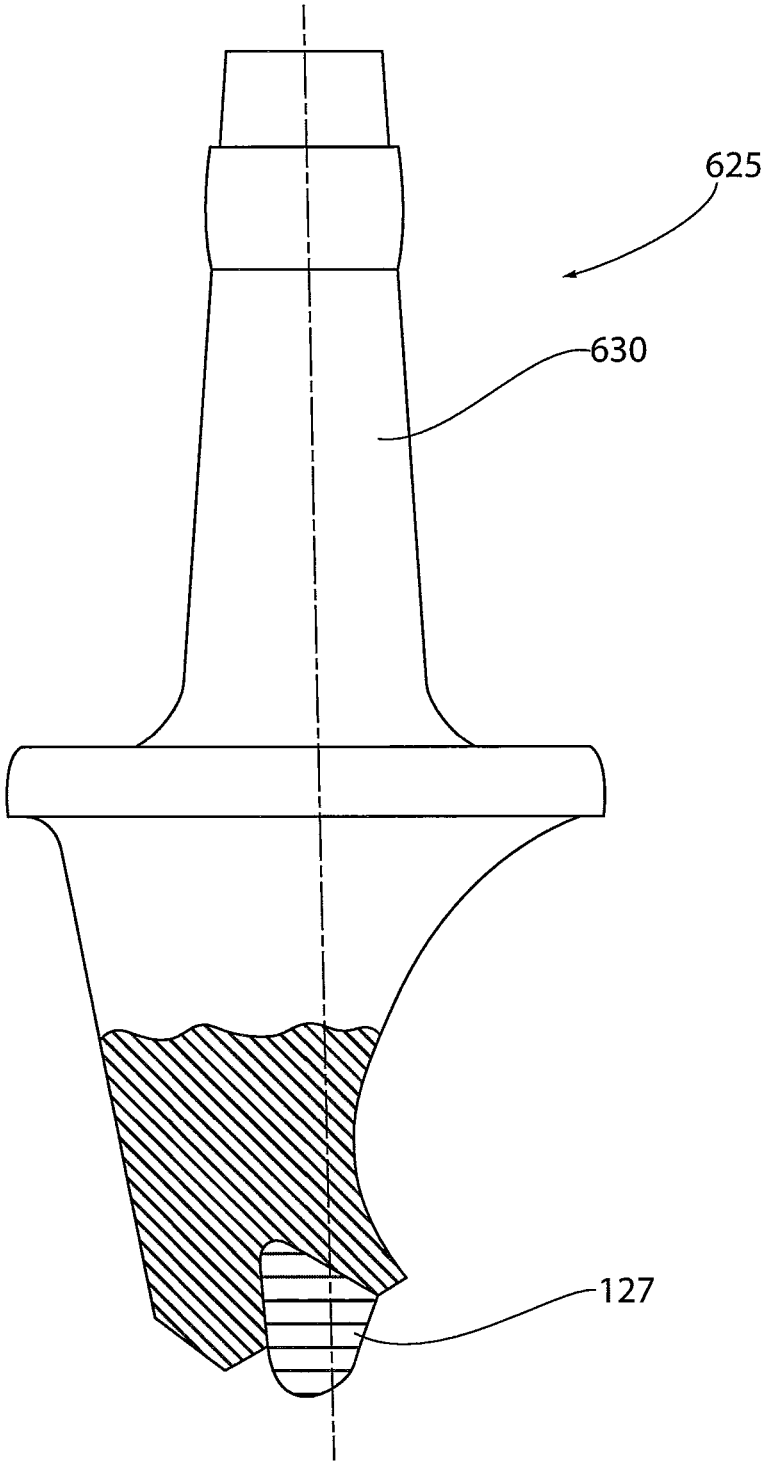
FIG. 15 is a side view similar to FIG. 5 but with the insert mounted directly to the cutter bit body.

FIG. 15 illustrates an insert 127 identical to the insert previously discussed. However, unlike the previous embodiments, the insert 127 is mounted directly to the body 630 of the cutter bit 625. The insert 127, whether it is made from cemented carbide, PCD, or CBN may be secured to the steel body 630 using techniques known in the art.

While the discussion has been directed to the use of cutter bits for a mining or construction operation, it should be appreciated that the insert in accordance with this invention may also be applied to oil and/or gas drilling operations.

Furthermore, it should be appreciated that the modified insert disclosed herein provides improved performance over other conventional inserts, even when the tip is not coated with PCD or CBN.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

The invention claimed is:

1. An insert used for earthworking and/or road milling applications comprising a body with a first end and a second end, wherein the body comprises:

a) a base extending from the first end and a central longitudinal axis through the base, wherein the base is defined by an ellipsoid about the longitudinal axis;

b) an apex at the second end, wherein the apex is offset from the longitudinal axis;

c) a transition region between the base and the apex, wherein the transition region is symmetric about a plane extending through the apex and through the longitudinal axis; and d) wherein when viewed along the longitudinal axis toward the first end, the apex region is generally elliptical and wherein the major axis of the ellipse is parallel to and overlapping with the plane.

2. The insert according to claim 1, wherein a region surrounding the apex has a radius.

3. The insert according to claim 2, wherein the radius is between 0.05 and 0.25 inches and the diameter of the base at the intersection with the transition region is 0.57 inches.

4. The insert according to claim 2, wherein when viewed from the direction facing the plane, the transition region opposite a rake side is the relief side and generally curvilinear with a straight segment transitioning to the base.

5. The insert according to claim 4, wherein the straight segment of the relief side adjacent to the base forms an angle B of between 8-14° with the centerline.

6. The insert according to claim 1, wherein the region surrounding the apex has a flat with radiussed portions blending to the transition region.

7. The insert according to claim 1, wherein the ellipsoid is one of a cylinder, a frusto-conical section, an elliptical section and a tapered elliptical section.

8. The insert according to claim 1, wherein when viewed from a direction facing the plane, a rake side of the transition region is generally straight extending over one-half the diameter D of the insert body and forms an obtuse angle A with respect to the centerline.

9. The insert according to claim 8, wherein the base diameter D is 0.50 inches and the rake side has a straight portion with a length of approximately 0.30 inches.

10. The insert according to claim 1, wherein the transition region is conical.

11. The insert according to claim 1, wherein a tip includes the apex and transition region and wherein the body and the tip are cemented carbide and, wherein there is a coating of PCD or CBN covering only the tip.

12. The insert according to claim 1, wherein a tip includes the apex and transition region and wherein the body is cemented carbide and the tip is entirely PCD or CBN.

13. The insert according to claim 1, wherein a tip includes the apex and transition region and wherein the tip and a portion of the body are PCD or CBN while the remainder of the body is cemented carbide.

14. The insert according to claim 13, wherein the PCD or CBN portion is mated to the remaining body along mating surfaces and wherein the mating surface of the PCD or CBN portion has a protrusion.

15. The insert according to claim 14, wherein the protrusion is centered about a line offset from and parallel to the central longitudinal axis of the body.

16. The insert according to claim 15, wherein the protrusion is defined by a radius.

17. A non-rotatable cutter bit comprising:

a) a body having a central longitudinal axis extending therethrough;

b) an insert holder secured within the body;

c) an insert secured within the insert holder, wherein the insert has a body with a first end and a second end, wherein the body comprises:

1) a base extending from the first end and a longitudinal centerline through the base, wherein the base is defined by an ellipsoid;
2) an apex at the second end, wherein the apex is offset from the centerline defining a rake face side and a relief face side;
3) a transition region between the base and the apex, wherein the transition region is symmetric about a plane extending through the apex and through the centerline; and d) wherein the central longitudinal axis extends through the apex.

18. The non-rotatable bit according to claim 17, wherein for at least 90% of the length of the rake face, a projection perpendicular to the rake face toward the longitudinal axis intersects with the body of the bit holder.

19. The non-rotatable bit according to claim 17, wherein for at least 90% of the length of the rake face side, a projection perpendicular to the longitudinal axis through the rake face intersects with the body of the bit holder.

20. The non-rotatable bit according to claim 17, wherein the insert is brazed within holder of the bit body.

21. The non-rotatable bit according to claim 17, wherein the insert has tip that includes the apex and transition region and wherein the body and the tip are cemented carbide and, wherein there is a coating of PCD or CBN covering only the tip.

22. The non-rotatable bit according to claim 17, wherein the insert has a tip that includes the apex and transition region and wherein the body is cemented carbide and the tip is entirely PCD or CBN.

23. The non-ratable bit according to claim 17, wherein the insert has a tip that includes the apex and transition region and wherein the tip and a portion of the body are PCD or CBN while the remainder of the body is cemented carbide.

24. The non-rotatable bit according to claim 23, wherein the PCD or CBN portion is mated to the remaining body along mating surfaces and wherein the mating surface of the PCD or CBN portion has a protrusion.

25. The non-rotatable bit according to claim 24, wherein the protrusion is centered about a line offset from and parallel to the central longitudinal axis of the body.

26. The insert according to claim 25, wherein the protrusion is defined by a radius.

27. A non-rotatable cutter bit comprising:

a) a body having a central longitudinal axis extending therethrough;
b) an insert secured to the body, wherein the insert has a body with a first end and a second end, wherein the body comprises:
1) a base extending from the first end and a longitudinal centerline through the base, wherein the base is defined by an ellipsoid;
2) an apex at the second end, wherein the apex is offset from the centerline defining a rake face side and a relief face side;
3) a transition region between the base and the apex, wherein the transition region is symmetric about a plane extending through the apex and through the centerline; and
d) wherein the central longitudinal axis extends through the apex.

28. The non-rotatable hit according to claim 27, wherein for at least 90% of the length of the rake face, a projection perpendicular to the rake face toward the longitudinal axis intersects with the body of the bit holder.

29. The non-rotatable bit according to claim 27, wherein for at least 90% of the length of the rake face side, a projection perpendicular to the longitudinal axis through the rake face intersects with the body of the bit holder.

30. An insert used for earthworking and/or road milling applications comprising a body with a first end and a second end, wherein the body comprises:

a) a base extending from the first end and a central longitudinal axis through the base, wherein the base is defined by an ellipsoid about the longitudinal axis;
b) an apex at the second end, wherein the apex is offset from the longitudinal axis, wherein a tip includes the apex and transition region and wherein the tip and a portion of the body are PCD or CBN while the remainder of the body is cemented carbide;
c) a transition region between the base and the apex, wherein the transition region is symmetric about a plane extending through the apex and through the longitudinal axis;
d) wherein the PCD or CBN portion is mated to the remaining body along mating surfaces and wherein the mating surface of the PCD or CBN portion has a protrusion and wherein the protrusion is centered about a line offset from and parallel to the central longitudinal axis of the body.

31. A non-rotatable cutter bit comprising:

a) a body having a central longitudinal axis extending therethrough;
b) an insert holder secured within the body;
c) an insert secured within the insert holder, wherein the insert has a body with a first end and a second end, wherein the body comprises:
1) a base extending from the first end and a longitudinal centerline through the base, wherein the base is defined by an ellipsoid;
2) an apex at the second end, wherein the apex is offset from the centerline defining a rake face side and a relief face side, wherein the insert has a tip that includes the apex and transition region and wherein the tip and a portion of the body are PCD or CBN while the remainder of the body is cemented carbide, wherein the PCD or CBN portion is mated to the remaining body along mating surfaces and wherein the mating surface of the PCD or CBN portion has a protrusion, wherein the protrusion is centered about a line offset from and parallel to the central longitudinal axis of the body;
3) a transition region between the base and the apex, wherein the transition region is symmetric about a plane extending through the apex and through the centerline; and
d) wherein the central longitudinal axis extends through the apex.

* * * * *